US006718846B1

(12) United States Patent
Ellison

(10) Patent No.: US 6,718,846 B1
(45) Date of Patent: Apr. 13, 2004

(54) APPARATUS FOR ALIGNING A BEARING MEMBER WITH AN ACTUATOR

(75) Inventor: Mark S. Ellison, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/422,218

(22) Filed: Apr. 24, 2003

(51) Int. Cl.[7] ..... G05G 1/10; F01L 1/18
(52) U.S. Cl. ..... 74/559; 74/519; 123/90.39
(58) Field of Search ..... 384/245; 74/519, 74/559; 123/90.12, 90.39, 321, 322; 92/179

(56) References Cited

U.S. PATENT DOCUMENTS

| | | | | | |
|---|---|---|---|---|---|
| 2,847,261 | A | * | 8/1958 | Cornelius | 92/179 |
| 3,859,973 | A | | 1/1975 | Dreisin | |
| 5,165,375 | A | | 11/1992 | Hu | |
| 5,195,489 | A | | 3/1993 | Reich | |
| 5,365,916 | A | | 11/1994 | Freiburg et al. | |
| 5,479,896 | A | | 1/1996 | Freiburg et al. | |
| 5,564,385 | A | * | 10/1996 | Hakansson | 123/321 |
| 5,611,308 | A | | 3/1997 | Hackett | |
| 5,645,031 | A | * | 7/1997 | Meneely | 123/322 |
| 6,463,898 | B1 | * | 10/2002 | Yates | 123/90.39 |
| 6,553,950 | B2 | * | 4/2003 | Chiappini et al. | 123/90.12 |

FOREIGN PATENT DOCUMENTS

| | | | | |
|---|---|---|---|---|
| DE | 019505406 A1 | * | 8/1996 | 74/519 X |
| JP | 8-200019 | * | 8/1996 | 74/519 X |

* cited by examiner

*Primary Examiner*—Vinh T. Luong
(74) *Attorney, Agent, or Firm*—Steve D Lundquist

(57) ABSTRACT

An apparatus for aligning a bearing member with an actuator. The apparatus includes an actuator having a substantially cylindrical shape and disposed about an axis, a substantially spherical end on the actuator, a bearing member having a substantially spherical opening for housing the spherical end, the spherical end and the spherical opening being configured such that the bearing member is held in swiveling contact by the spherical end, a spring retainer located on the actuator a desired distance from the spherical end, and a spring located about the actuator from the spring retainer to the bearing member such that a spring force is placed on the bearing member to maintain alignment of the bearing member with the axis.

6 Claims, 3 Drawing Sheets

100

APPARATUS FOR ALIGNING A BEARING MEMBER WITH AN ACTUATOR

TECHNICAL FIELD

This invention relates generally to an apparatus for maintaining an orientation of a bearing member with an actuator and, more particularly, to an apparatus for maintaining an orientation of a bearing member pivotally attached to an actuator rod with respect to an axis of the rod.

BACKGROUND

It is often desired in machine applications to drive a component which pivots in a rotating fashion by an actuator component which moves in a linear direction. For example, internal combustion engines often include rocker arms which pivot about a point to control operation of valves, injectors, and the like. The rocker arms are themselves driven by rods which push against one end of the rocker arm in a linear motion.

The juncture of a linear motion part with an angular motion part results in unequal and erratic contact of the surfaces of the two parts. A rod with an essentially flat end, contacting a portion of a rocker arm with an essentially flat end, results in an inability to maintain full contact of the flat surfaces as the rocker arm pivots. This inability results in stresses on the components and wear of the material.

Historically, manufacturers of these components have attempted to compensate by such means as rounding the tips of the rods to try to maintain a more consistent contact area between the rods and the rocker arms. Design changes such as these have met with limited success.

More recent design attempts have incorporated bearing members, such as buttons or feet, between the rods and the rocker arms. These bearing members typically pivotally attach to the rods and have flat outer surfaces designed to engage the rocker arms more evenly and consistently. Examples of this approach may be found in U.S. Pat. No. 5,165,375 to Hu, U.S. Pat. No. 5,195,489 to Reich, and U.S. Pat. No. 5,365,916 to Freiburg et al., in which a bearing member of some kind is pivotally attached to a substantially spherically shaped end of a push rod, the bearing member having a flat surface to maximize engagement with a rocker arm.

In each of the above cases, attempts are made to maintain a desired alignment between the rods and the bearing members by the use of springs, clips, o-rings, and the like located where the rods and the members contact each other. These attempts, however, do not ensure that alignment will be maintained, and also may contribute to wearing and eventual breakdown of the contact surfaces.

The present invention is directed to overcoming one or more of the problems as set forth above.

SUMMARY OF THE INVENTION

In one aspect of the present invention an apparatus for aligning a bearing member with an actuator is disclosed. The apparatus includes an actuator having a substantially cylindrical shape and disposed about an axis, a substantially spherical end on the actuator, a bearing member having a substantially spherical opening for housing the spherical end, the spherical end and the spherical opening being configured such that the bearing member is held in swiveling contact by the spherical end, a spring retainer located on the actuator a desired distance from the spherical end, and a spring located about the actuator from the spring retainer to the bearing member such that a spring force is placed on the bearing member to maintain alignment of the bearing member with the axis.

DETAILED DESCRIPTION

Figure 1B:
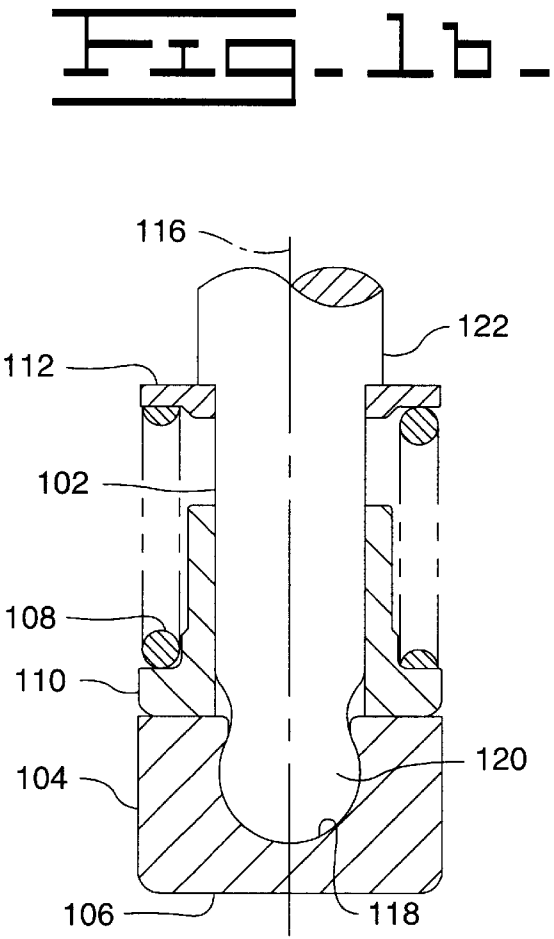
FIG. 1*b* illustrates a variation of the embodiment of FIG. 1*a*.

Referring to the drawings, an apparatus 100 for aligning a bearing member 104 with an actuator 102 is shown. The apparatus 100 finds particular use when the actuator 102 employs a linear moving force to engage and move a device which responsively moves in a rotating manner. The bearing member 104, while attached to the actuator 102, is free to swivel with respect to the actuator 102, thus maintaining consistent contact with the rotating device. An example of such a configuration includes a rocker arm, e.g., in an internal combustion engine, which rotates as it is driven by a linearly moving pushrod.

Figure 1A:
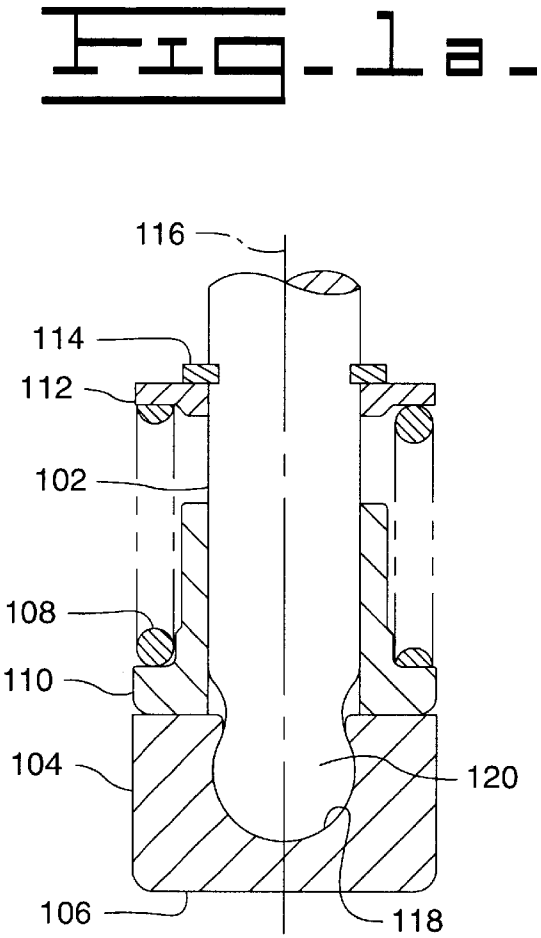
FIG. 1*a* is a diagrammatic cross section illustration of a preferred embodiment of the present invention.

Referring particularly to FIG. 1*a*, a diagrammatic illustration of a preferred embodiment of the present invention is shown. An actuator 102, hereinafter referred to as a pin 102, has a substantially cylindrical shape and is disposed about an axis 116 for reference. It is noted that only the relevant end of the pin 102 is shown to depict the present invention. The pin 102 may be part of a more complete actuator, such as a hydraulically or mechanically driven actuator. Preferably, the pin 102 includes a substantially spherical end 120, in particular a convex spherical shape.

A bearing member 104, hereinafter referred to as a button 104 and commonly known in the art as a foot, includes a substantially spherical opening 118, i.e., an inner surface, and has in particular a concave spherical shape. The spherical end 120 and the spherical opening 118 may be configured so that the button 104 is held in swiveling contact by the spherical end 120. More particularly, the spherical end 120 and the spherical opening 118 may be sized such that the spherical end 120 fits completely into the spherical opening 118, yet allows freedom of pivotal motion of the button 104 with respect to the pin 102. In addition, the spherical opening 118 is configured to be held in place by the spherical end 120, for example by "snapping" the button 104 to the pin 102.

Figure 4:
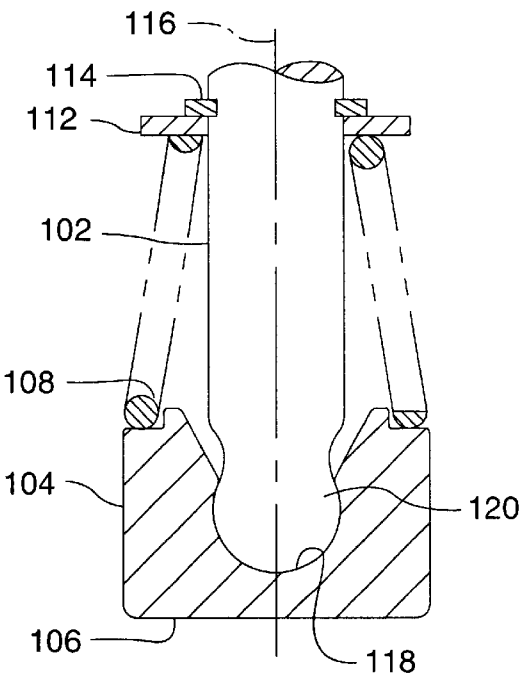
FIG. 4 is a diagrammatic cross section illustration of still another embodiment.

A spring retainer 112 is located on the pin 102 a desired distance from the spherical end 120. The spring retainer 112 may be shaped like a washer, as shown in FIG. 4, or may have variations in shape suited to retain a spring. Alternatively, the spring retainer 112 may be an integral portion of the pin 102. For example, the pin 102 may be machined to include a ridge at a desired location to function as a spring retainer.

A retaining ring 114 may be mounted on the pin 102 to maintain the spring retainer 112 at a desired position. The retaining ring 114 may be a split ring, a spring clip, an o-ring, or some other suitable retainer. The pin 102 may have a groove machined therein for mounting of the retaining ring 114. In an alternative embodiment, such as is shown in FIG. 1*b*, the pin 102 may have an increased diameter portion 122 to maintain the spring retainer 112 at the desired position.

A spring 108 is located about the pin 102 from the spring retainer 112 to the button 104 such that a force is placed by the spring 108 on the button 104 to maintain alignment of the button 104 with the axis 116. Although the drawings indicate alignment in two dimensions, it is noted that the spring 108 is configured to maintain alignment about the circumference of the pin 102, i.e., in three dimensions. The spring 108 may have a constant diameter or may be shaped otherwise, such as a tapered spring as shown in FIG. 4.

Figure 3:
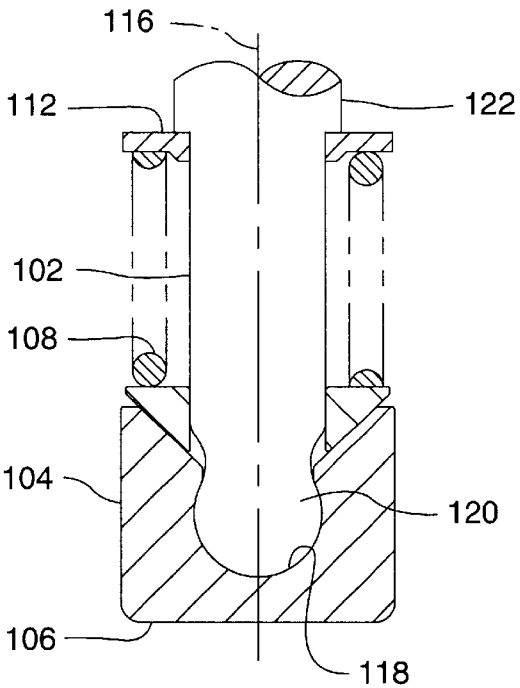
FIG. 3 is a diagrammatic cross section illustration of yet another embodiment.
Figure 2:
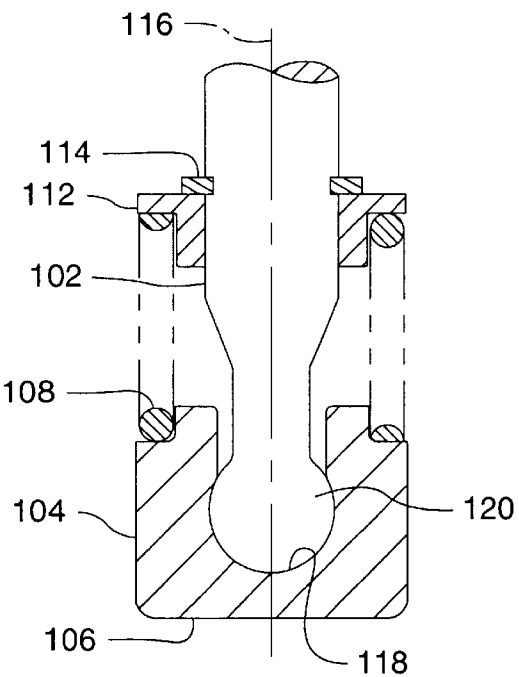
FIG. 2 is a diagrammatic cross section illustration of an alternate embodiment.

In one embodiment, as depicted by FIGS. 2 and 4, the spring 108 may directly engage the button 104. The button 104 in these cases may be machined to hold the spring 108 in place. In another embodiment, the spring 108 may engage a guide 110 located about the pin 102 and positioned between the spring 108 and the button 104 such that the force of the spring 108 is placed on the button 104 by way of the guide 110. A preferred embodiment of the guide 110 is shown in FIGS. 1*a* and 1*b*. However, other guide configurations may be used, such as for example the tapered guide 110 shown in FIG. 3.

The button 104 may include a substantially flat surface 106 located opposite the spherical opening 118. The flat surface 106 may be configured to engage in contact with a pivoting member 502, as described below.

Industrial Applicability

Figure 5:
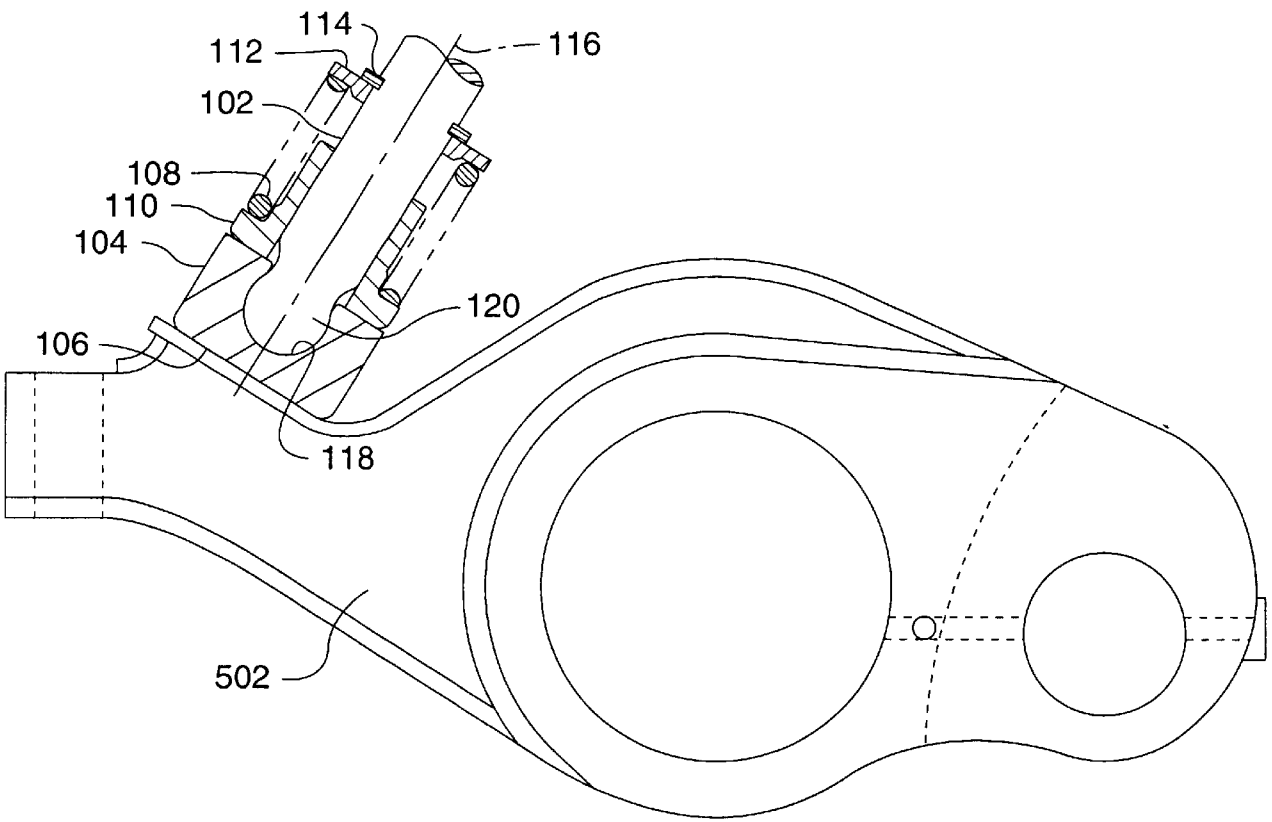
FIG. 5 is a diagrammatic illustration of an application of the present invention with a pivoting member.

An example of operation of the present invention may be described with reference to FIG. 5. A pivoting member 502, such as a rocker arm in an internal combustion engine, is configured to rotate about a pivot point in a manner well known in the art. Typically, the pivoting member 502 is driven by a linearly moving actuator, such as the pin 102. As the pin 102 pushes against the pivoting member 502, the flat surface 106 of the button 104 engages in contact with the pivoting member 502, and is free to pivot relative to the pin 102 to maintain flat contact with the pivoting member 502. Thus, although a linearly moving object is engaging a rotating object, the pivotal movement of the button 104 results in consistent contact of the actuator 102 with the pivoting member 502.

As the pin 102 withdraws, i.e., moves away, from the pivoting member 502, the force of the spring 108 acting against the button 104 serves to maintain the button 104 in alignment with respect to the axis 116. As a result, when the pin 102 next moves forward to engage the pivoting member 502, the button 104 is in proper alignment for the flat surface 106 to fully contact the pivoting member 502.

Other aspects can be obtained from a study of the drawings, the disclosure, and the appended claims.

What is claimed is:

1. An apparatus for aligning a bearing member with an actuator, comprising:

the actuator having a substantially cylindrical shape and disposed about an axis;

a substantially spherical end on the actuator;

the bearing member having a substantially spherical opening for housing the spherical end, the spherical end and the spherical opening being configured such that the bearing member is held in swiveling contact by the spherical end;

a spring retainer located on the actuator a desired distance from the spherical end; and a spring located about the actuator from the spring retainer to the bearing member such that a spring force is placed on the bearing member to maintain alignment of the bearing member with the axis.

2. An apparatus, as set forth in claim 1, further including a guide located about the actuator and positioned between the spring and the bearing member such that the spring force is placed on the bearing member by way of the guide.

3. An apparatus, as set forth in claim 1, further including a retaining ring mounted on the actuator to maintain the spring retainer at a desired position.

4. An apparatus, as set forth in claim 1, wherein the actuator includes an increased diameter portion located to maintain the spring retainer at a desired position.

5. An apparatus, as set forth in claim 1, wherein the bearing member includes a substantially flat surface located opposite the spherical opening.

6. An apparatus, as set forth in claim 5, wherein the flat surface is configured to engage in contact with a pivoting member.

* * * * *